US008474659B2

(12) United States Patent
Dennis

(10) Patent No.: US 8,474,659 B2
(45) Date of Patent: Jul. 2, 2013

(54) MULTI-CHAMBER FLUID DISPENSING CONTAINER WITH DIP TUBES

(75) Inventor: Stephen R. Dennis, Danville, CA (US)

(73) Assignee: The Clorox Company, Oakland, CA (US)

( * ) Notice: Subject to any disclaimer, the term of this patent is extended or adjusted under 35 U.S.C. 154(b) by 222 days.

(21) Appl. No.: 13/069,637

(22) Filed: Mar. 23, 2011

(65) Prior Publication Data

US 2012/0241474 A1 Sep. 27, 2012

(51) Int. Cl.
*B67D 7/70* (2010.01)
*B67D 7/58* (2010.01)

(52) U.S. Cl.
USPC ..... 222/137; 222/145.1; 222/145.5; 222/382

(58) Field of Classification Search
USPC ..... 222/137, 145.1, 145.5, 321.7–321.9, 222/382, 383.1, 464.1
See application file for complete search history.

(56) References Cited

U.S. PATENT DOCUMENTS

| | | | | | |
|---|---|---|---|---|---|
| 4,863,071 | A | | 9/1989 | Guss et al. | |
| 5,009,342 | A | * | 4/1991 | Lawrence et al. | 222/136 |
| 5,158,191 | A | | 10/1992 | Douglas et al. | |
| 5,246,146 | A | | 9/1993 | Bartimes et al. | |
| 5,337,928 | A | | 8/1994 | Foster et al. | |
| 5,402,916 | A | * | 4/1995 | Nottingham et al. | 222/134 |
| 5,464,129 | A | * | 11/1995 | Ho | 222/377 |
| 5,626,259 | A | * | 5/1997 | Maas et al. | 222/136 |
| 5,752,626 | A | * | 5/1998 | Bachand | 222/136 |
| D402,553 | S | * | 12/1998 | Webster et al. | D9/741 |
| 5,857,591 | A | * | 1/1999 | Bachand | 222/1 |
| 5,954,213 | A | | 9/1999 | Gerhart et al. | |
| 6,702,157 | B1 | | 3/2004 | Dobbs | |
| 6,758,411 | B2 | | 7/2004 | Conway et al. | |
| 7,325,706 | B2 | | 2/2008 | Sweeton et al. | |
| 7,478,739 | B2 | | 1/2009 | Foster | |
| 7,490,743 | B2 | | 2/2009 | Herzog | |
| 7,594,594 | B2 | * | 9/2009 | Troost et al. | 222/145.5 |
| 7,875,001 | B2 | * | 1/2011 | Minotti | 604/82 |
| 2009/0212077 | A1 | * | 8/2009 | Carden | 222/382 |
| 2009/0314811 | A1 | | 12/2009 | Dennis | |

* cited by examiner

*Primary Examiner* — Kevin P Shaver
*Assistant Examiner* — Nicholas J Weiss
(74) *Attorney, Agent, or Firm* — Thomas C. Feix

(57) ABSTRACT

Described is a multi-chamber fluid dispensing container with multiple dip tubes, and a package including the container and trigger sprayer having multiple supply lines for fluid connection to the multiple dip tubes. The container includes a body having a first wall defining a first interior volume and a second wall defining a second interior volume, a first dip tube fluidly connected to the first interior volume, and a second dip tube fluidly connected to the second interior volume. The package may include the container and a trigger sprayer coupled to the container, and fluidly connected to the first dip tube and to the second dip tube. Other embodiments may also be disclosed and claimed.

15 Claims, 8 Drawing Sheets

MULTI-CHAMBER FLUID DISPENSING CONTAINER WITH DIP TUBES

BACKGROUND

1. Field of the Invention

Embodiments of the present disclosure relate to bottles having multiple chambers, each having a dip tube formed therein, and to packages including the multi-chamber bottle and a trigger sprayer having multiple supply lines for fluid connection to the multiple dip tubes.

2. Description of the Related Art

Trigger sprayers are those types of sprayers that can be held in a single hand of the user and operated by the fingers of the user's hand to pump fluid from a container connected to the trigger sprayer. A trigger sprayer typically includes a sprayer housing that contains a pump chamber and piston, and a sprayer fluid supply passageway that fluidly communicates a fluid inlet opening (sometimes also referred to as a "connector aperture") with the pump chamber.

A dip tube is often sealingly coupled to the connector aperture, and extends through a neck of a container and into fluid contents of the container. The dip tube fluidly communicates the container with the fluid supply passageway of the sprayer housing.

Although the conventional trigger sprayer and container may be suitable for various applications, there may be situations in which it is undesirable to package a fluid product in a container due to instability or hazardousness of the fluid product. In these situations, mixing at the point of use of precursor fluids may be a suitable alternative.

SUMMARY OF THE INVENTION

The present disclosure provides a multi-chamber fluid dispensing container comprising a body having a first wall defining a first interior volume and a second wall defining a second interior volume, a neck coupled to the body and defining a first opening to the first interior volume and a second opening to the second interior volume, a first dip tube, and a second dip tube. The first dip tube may be formed to the first wall, separated from the first wall by a first partition, fluidly connected to the first interior volume at a bottom of the body, and fluidly connected to the first interior volume below a top of the neck. The second dip tube may be formed to the second wall, separated from the second wall by a second partition, fluidly connected to the second interior volume at a bottom of the body, and fluidly connected to the second interior volume below the top of the neck.

The present disclosure also provides a multi-chamber fluid dispensing package comprising a multi-chamber fluid dispensing container and a trigger sprayer coupled to the container. The multi-chamber fluid dispensing container may comprise a first dip tube formed to a first wall of a body of the container, separated from the first wall by a first partition, and fluidly connected to a first interior volume of the container, and may further comprise a second dip tube formed to a second wall of the body of the container, separated from the second wall by a second partition, and fluidly connected to a second interior volume of the container. The trigger spray may be fluidly connected to the first dip tube, and to the second dip tube.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF EMBODIMENTS

Figure 1:
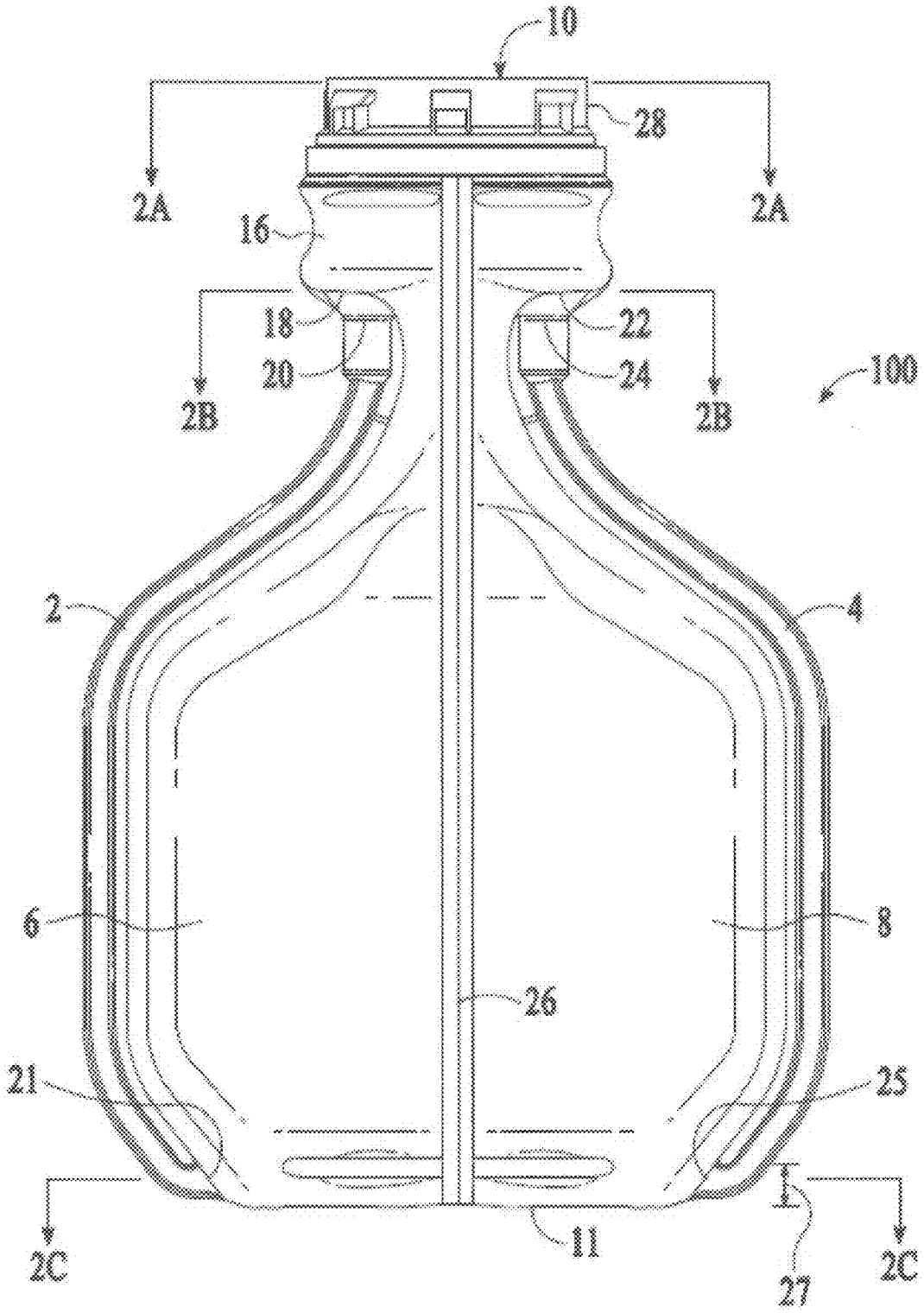
FIG. 1 shows a side elevation view of a multi-chamber fluid dispensing container, in accordance with a first embodiment of the present disclosure.

Reference will now be made to the drawings wherein like numerals refer to like parts throughout. For ease of description, the components of embodiments of the present invention are described in the normal (upright) operating position, and terms such as upper, lower, horizontal, etc., are used with reference to this position. It will be understood, however, that the components of embodiments of the present invention may be manufactured, stored, transported, used, and sold in an orientation other than the position described.

Figures illustrating the components of embodiments of the present invention show some conventional mechanical elements that may be known and that may be recognized by one skilled in the art. The detailed descriptions of such elements that are not necessary to an understanding of the invention, and accordingly are herein presented only to the degree necessary to facilitate an understanding of the novel features of the present invention.

As used herein and in the appended claims, the term "comprising" is inclusive or open-ended and does not exclude additional unrecited elements, compositional components, or method steps. Accordingly, the term "comprising" encompasses the more restrictive terms "consisting essentially of" and "consisting of."

It must be noted that, as used in this specification and the appended claims, the singular forms "a," "an," and "the" include plural references unless the content clearly dictates otherwise. Similarly, the use of substantially any plural terms herein may be translated by those having skill in the art from the plural to the singular as is appropriate to the context and/or application. The various singular/plural permutations may be expressly set forth herein for sake of clarity.

In those instances where a convention analogous to "at least one of A, B, and C, etc." is used, in general such a construction is intended in the sense one having skill in the art would understand the convention (e.g., "an apparatus having at least one of A, B, and C" would include but not be limited to apparatuses that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 elements refers to groups having 1, 2, or 3 elements. Similarly, a group having 1-5 elements refers to groups having 1, 2, 3, 4, or 5 elements, and so forth.

Unless defined otherwise, all technical and scientific terms used herein have the same meaning as commonly understood by one of ordinary skill in the art to which embodiments of the present invention pertain. Although a number of methods and materials similar or equivalent to those described herein can be used in the practice of the present invention, the preferred materials and methods are described herein.

The term "container" or "bottle," as used herein, is meant to mean and include any container for holding a fluid material. A container or bottle may be made of any suitable material, depending upon the product therein. For example, a container or bottle may be made of plastic.

Broadly, embodiments of the present invention provide containers and fluid withdrawing assemblies for liquids. The container may include a body having a first wall defining a first interior volume and a second wall defining a second interior volume, a neck coupled to the body and defining a first opening to the first interior volume and a second opening to the second interior volume, a first dip tube, and a second dip tube. The first dip tube may be formed to the first wall, separated from the first wall by a first partition, fluidly connected to the first interior volume at a bottom of the body, and fluidly connected to the first interior volume below a top of the neck. The second dip tube may be formed to the second wall, separated from the second wall by a second partition, fluidly connected to the second interior volume at a bottom of the body, and fluidly connected to the second interior volume below the top of the neck.

Referring to FIG. 1, there is shown a side elevation view of an example container 100 in accordance with various embodiments of the present disclosure. The container 100 may include a first dip tube 2 formed as a channel along the first wall 6 of the container 100, and a second dip tube 4 formed as a channel along the second wall 8 of the container 100. The first dip tube 2 may extend along the first wall 6 from a first dip tube top opening 20 at a landing 18 below the top opening 10 of the container 100 to a first dip tube bottom opening 21 near the bottom 11 of the container 100. Similarly, the second dip tube 4 may extend along the second wall 8 from a second dip tube top opening 24 at a landing 22 below the top opening 10 of the container 100 to a second dip tube bottom opening 25 near the bottom 11 of the container 100.

As shown, the first wall 6 of the container 100 may define a first interior volume 7 and the second wall 8 of the container 100 may define a second interior volume 9. The neck 16 may be coupled to the body of the container and may define the opening 10. The opening 10 may comprise a first opening 12 (FIG. 2A) to the first interior volume 7, and a second opening 14 (FIG. 2A) to the second interior volume 9. A divider wall 26 may separate the interior volumes 7, 9 from each other.

Figure 3:
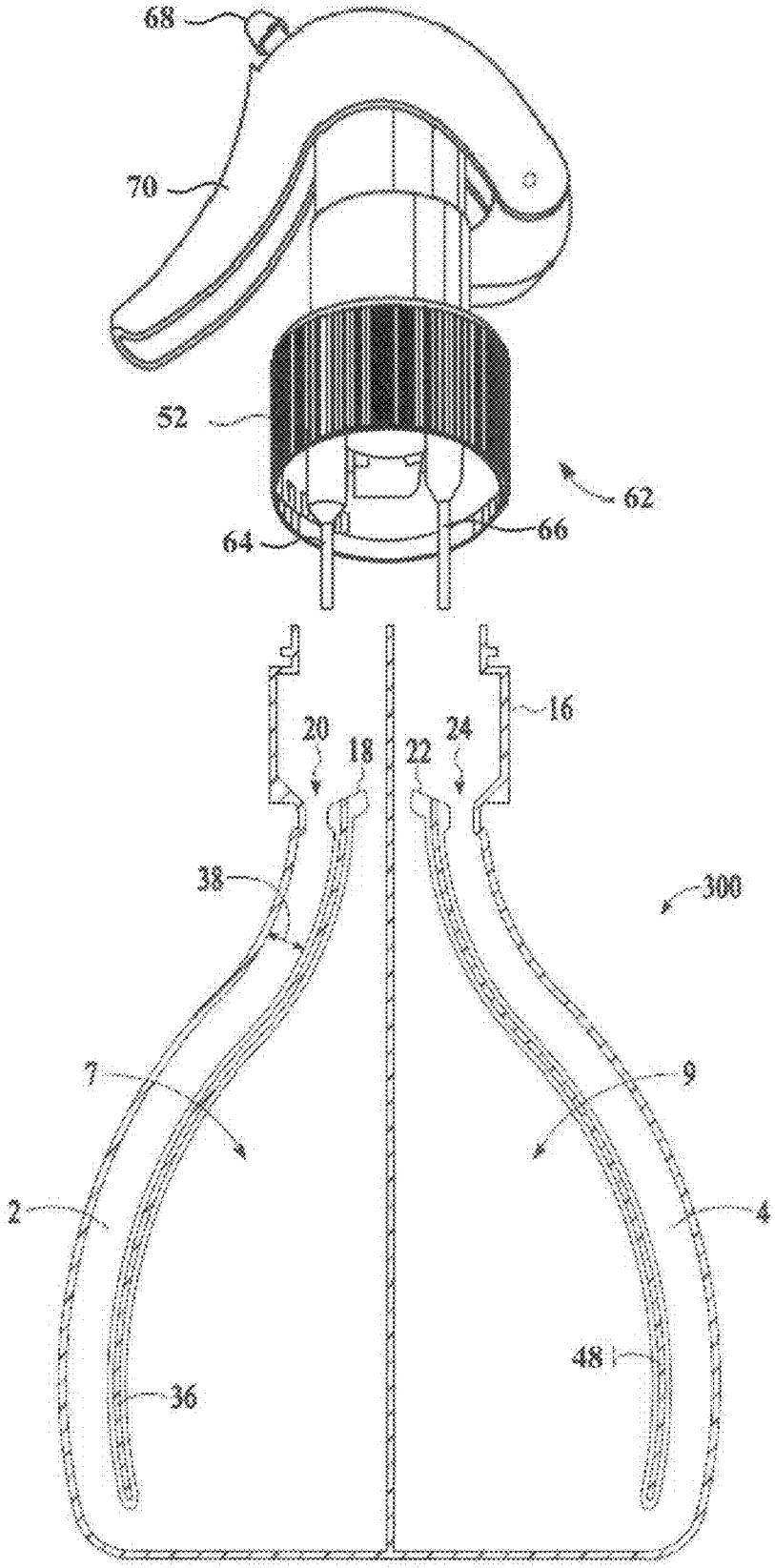
FIG. 3 shows a side elevation view of a fluid dispensing package including a multi-chamber fluid dispensing container, in accordance with a second embodiment of the present disclosure.

The dip tubes 2, 4 may stop a distance 27 from the bottom 11 of the container 100 so as to be in fluid communication with the interior volumes 7, 9 of the container 100. The distance 27 between the bottom of the dip tubes 2, 4 and the bottom 11 of the container 100 may be selected so that a bottom ends 21, 25 of the dip tubes 2, 4 are close enough to the bottom 11 such that fluid in the separate interior volumes 7, 9 of the container 100 may be taken up through the dip tubes 2, 4. The distance 27 may be further selected so that the bottom ends 21, 25 of the dip tubes 2, 4 are not too far from the bottom 11 of the container 100 such that substantially all of fluid in the container 100 is taken up through the dip tubes 2, 4. Typically, the distance 27 may be from about 0.5 to about 3 times a diameter 38 of the dip tubes 2, 4 (FIG. 3).

Figure 2A:
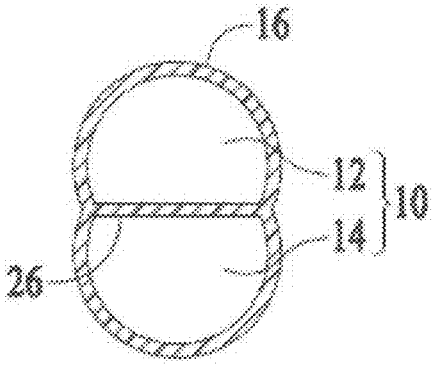
FIG. 2A shows a sectional plan view of the container of FIG. 1 taken along line 2A-2A.
Figure 2B:
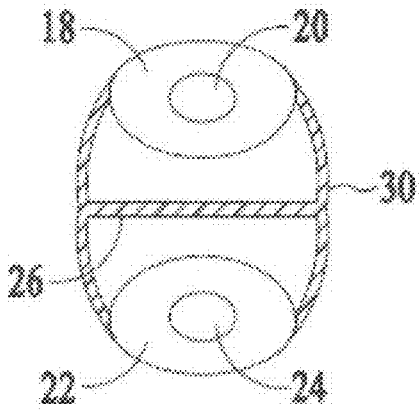
FIG. 2B shows a sectional plan view of the container of FIG. 1 taken along line 2B-2B.
Figure 2C:
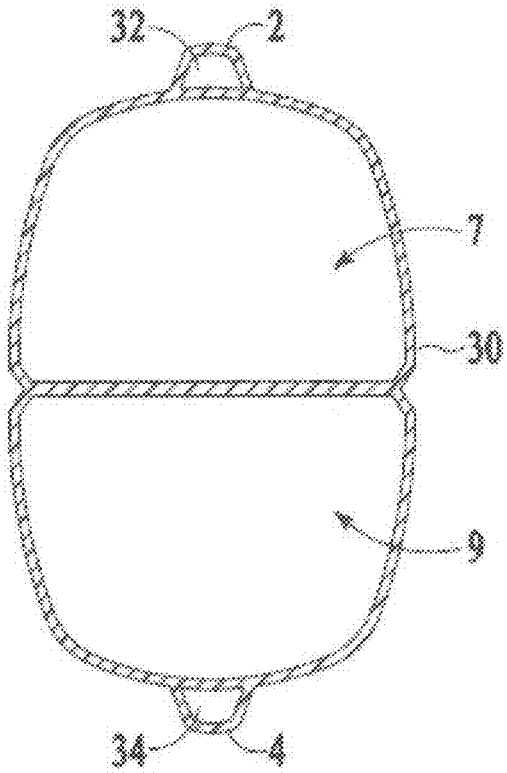
FIG. 2C shows a sectional plan view of the container of FIG. 1 taken along line 2C-2C.

To facilitate understanding of the structure of the container 100, various plan views are shown in FIG. 2A-2C. FIG. 2A is a sectional plan view of the container 100 taken generally along line 2A-2A of FIG. 1, showing the neck 16 and top opening 10. FIG. 2B is a sectional plan view of the container 100 taken generally along line 2B-2B of FIG. 1, showing the dip tube openings 20, 24, the landings 18, 22, and the bottle wall 30 (comprising wall sections 6, 8). FIG. 2C is a sectional plan view of the container 100 taken generally along line 2C-2C of FIG. 1, showing the dip tubes 2, 4, and the dip tube channels 32, 34.

As shown, the landings 18, 22 may be funnel shaped, rather than being flat, with one or more sides of each of the landing 18, 22 slanting inwards towards their respective dip tube top openings 20, 24. Although various other configurations may be similarly suitable, the funnel-shaped configuration may facilitate high-speed assembly of the container 100 and a trigger sprayer (described below) coupled to the container 100.

Figure 4:
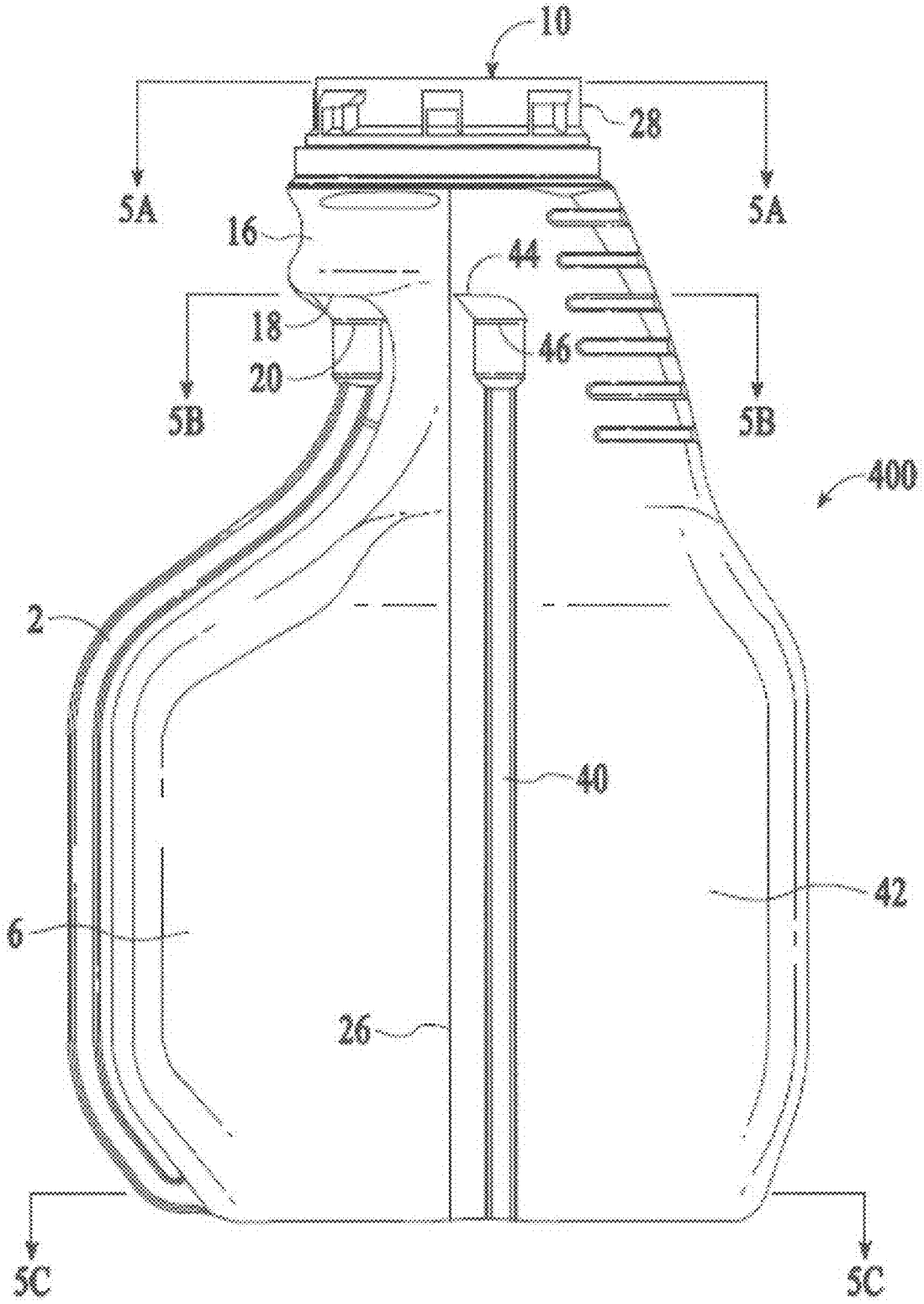
FIG. 4 shows a side elevation view of a multi-chamber fluid dispensing container, in accordance with a third embodiment of the present disclosure, wherein the multi-chamber dispensing container has a first interior volume that is larger than that of a second interior volume.

The container 100 may be configured to couple to an attachment connector of a trigger sprayer (described below). As shown, for example, the container 100 may include a bayonet-type fitment 28 for coupling to a complementary bayonet-type attachment connector of a trigger sprayer. Alternatively, the container 100 may include a threaded or snap-fit fitment for coupling the container 100 to a trigger sprayer. In various embodiments, the distance between the top of the neck 16 and the landings 18, 22 may be equal to a height of the fitment 28, or greater than a height of the fitment 28 (FIG. 4).

In various embodiments, one or both of the dip tubes 2, 4 may be completely separated from the walls 6, 8 on the exterior of the container 100 as in FIG. 1 or there may be a partition wall 36, 48 between each of the dip tubes 2, 4 and the walls 6, 8 as shown for the container 300 of FIG. 3. In various embodiments, it may be preferable for the dip tubes 2, 4 to be separated from the walls 6, 8 by the partition walls 36, 48 as this combination may provide increased stiffness to the container 300, allowing lighter weight to meet the same load requirements.

In various embodiments, as is shown in the side elevation view of FIG. 3, a trigger sprayer 62 having multiple supply lines 64, 66 may be attached to the neck 16 of the container 300. Each of the multiple supply lines 64, 66 may be attached to the dip tube openings 20, 24 at the landings 18, 22 of the container 300 to form a package.

Although various other types of trigger sprayers with multiple supply lines may be suitable for practicing the described invention, in various embodiments, the trigger sprayer 62 may combine a first fluid from the first interior volume 7 with a second fluid from the second interior volume 9, and discharge the combined fluid from the nozzle assembly 68 when the trigger 70 is actuated. More particularly, when the trigger 70 is configured to cause a first fluid to be drawn from the first interior volume 7 via the first dip tube 2 to the first supply line 64, and to draw a second fluid from second interior volume 9 via the second dip tube 4 o the second supply line 66. The first and second fluids may then be combined in the nozzle assembly 68.

As shown in FIG. 1 and FIG. 3, the dip tubes 2, 4 may be disposed on opposite sides of the container 100, 300. In various other embodiments, however, the dip tubes 2, 4 may instead be disposed such that the dip tubes 2, 4 face generally the same direction as illustrated for the container 400 of FIG. 4. As shown, the container 400 may include a first dip tube 2 configured similarly to that illustrated in FIG. 1. Rather than being disposed on the opposite of the container 400, the second dip tube 40 may extend along the second wall 42 from a second dip tube top opening 46 at a landing 44 below the top opening 10 of the container 400 to the bottom of the container 400.

Figure 5A:
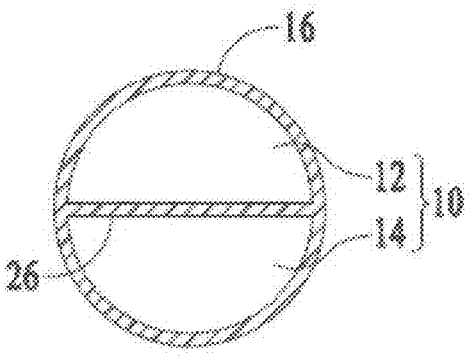
FIG. 5A shows a sectional plan view of the container of FIG. 4 taken along line 5A-5A.
Figure 5B:
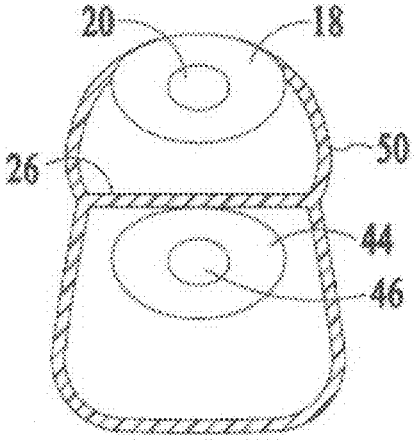
FIG. 5B shows a sectional plan view of the container of FIG. 4 taken along line 5B-5B.
Figure 5C:
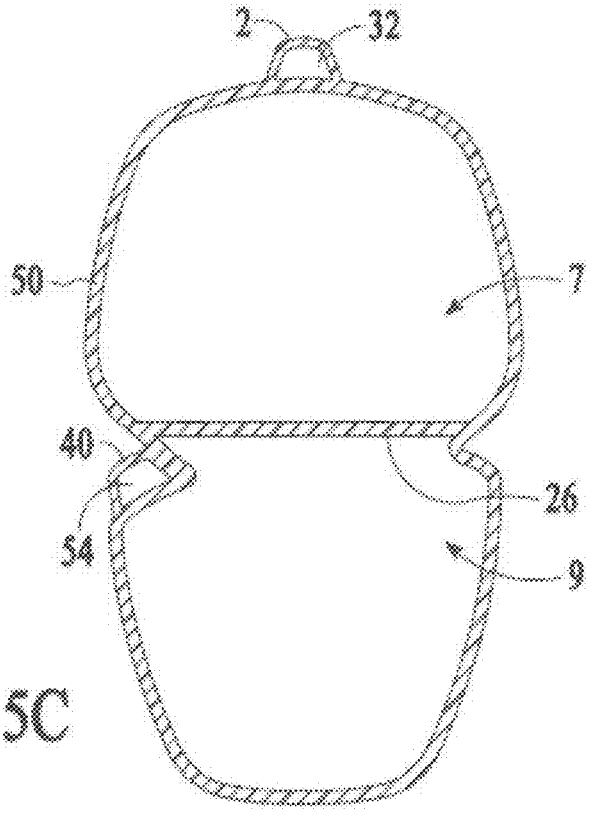
FIG. 5C shows a sectional plan view of the container of FIG. 4 taken along line 5C-5C.

To facilitate understanding of the structure of the container 400, various plan views are shown in FIG. 5A-5C. FIG. 5A is a sectional plan view of the container 400 taken generally along line 5A-5A of FIG. 4, showing the neck 16 and top opening 10. FIG. 5B is a sectional plan view of the container 400 taken generally along line 5B-5B of FIG. 4, showing the dip tube openings 20, 46, the landings 18, 44, and the bottle wall 50 (comprising walls 6, 42). FIG. 5C is a sectional plan view of the container 400 taken generally along line 5C-5C of FIG. 4, showing the dip tubes 2, 40, and the dip tube channels 32, 54.

Figure 6:
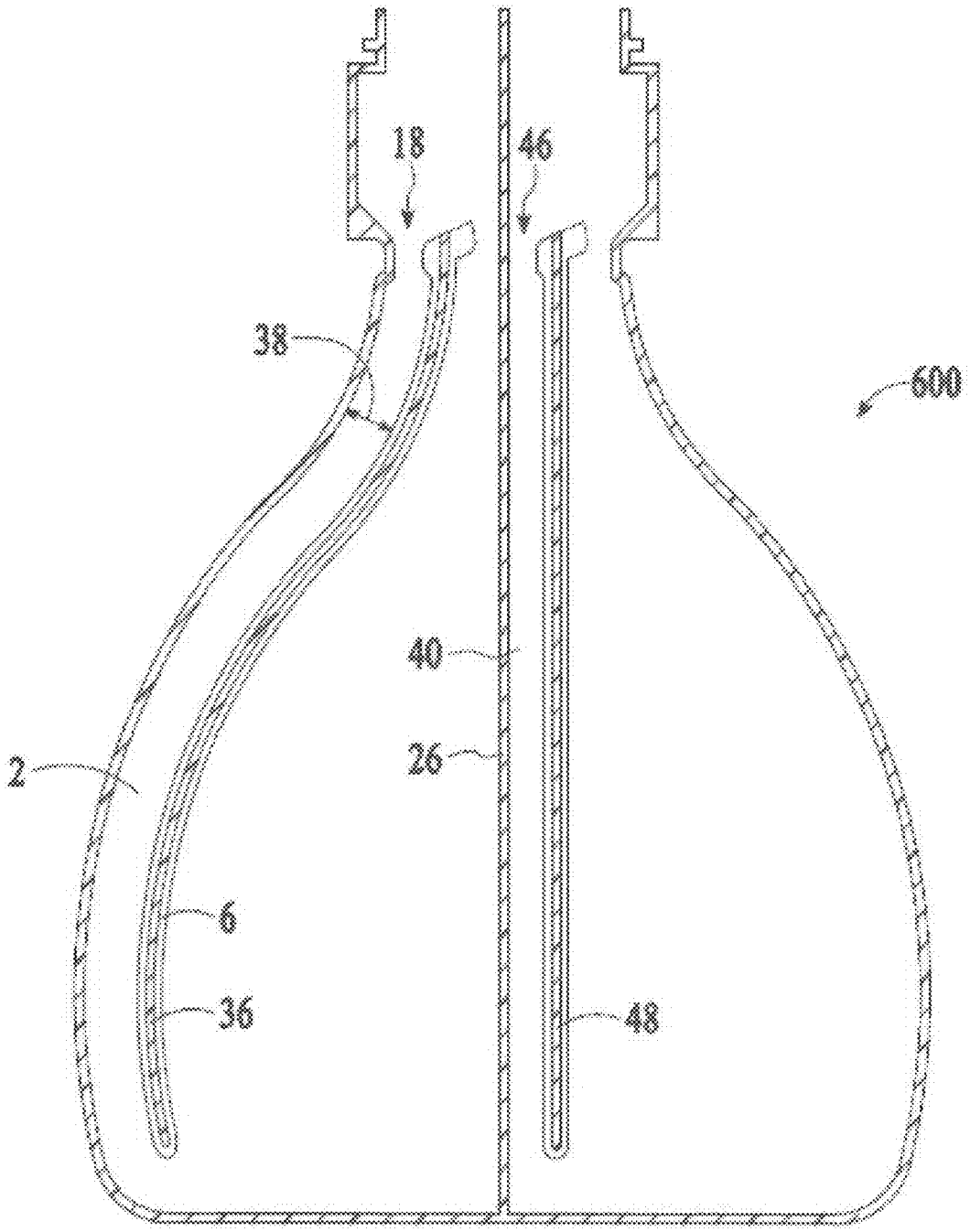
FIG. 6 shows a fragmentary side elevation view of a multi-chamber fluid dispensing container, in accordance with a fourth embodiment of the present disclosure.

Rather than being completely separated from the walls 6, 42 on the exterior of the container 400 as in FIG. 4, there may be a partition wall 36, 48 between each of the dip tubes 2, 40 and the walls 6, 42 as shown for the container 600 of FIG. 6. As noted herein, in various embodiments, it may be preferable for the dip tubes 2, 40 to be separated from the wall 6, 42 by the partition walls 36, 48 as this combination may provide increased stiffness to the container 600, allowing lighter weight to meet the same load requirements.

The containers described herein may be beneficial for applications in which mixing at the point of use of precursor fluids is desired. For example, it may be undesirable in some situations to package a fluid product in a container due to instability or hazardousness of the fluid product. In these situations, mixing at the point of use of precursor fluids may be a suitable alternative. To that end, for any one or more of the various embodiments described herein, the first interior volume 7 may hold a first precursor fluid, while the second interior volume 9 holds a second precursor fluid. The trigger sprayer (e.g., trigger sprayer 62) may then combine the precursor fluids and discharge the combined fluids.

In various embodiments, the ratio of precursor fluids may be other than one-to-one. To that end, the interior volumes of a container may have respective fluid capacities that are either the same as or different, and suitable for providing the desired combined fluid product. As shown in FIG. 4, for example, the container 400 may include a first interior volume 6 that is larger than that of the second interior volume 42. Additionally or alternatively, a trigger sprayer attached to the container may be configured to combine a first volume of the first precursor fluid from the first interior volume with a second volume of the second precursor fluid from the second interior volume, wherein the first volume is different from the second volume (not illustrated).

Figure 7:
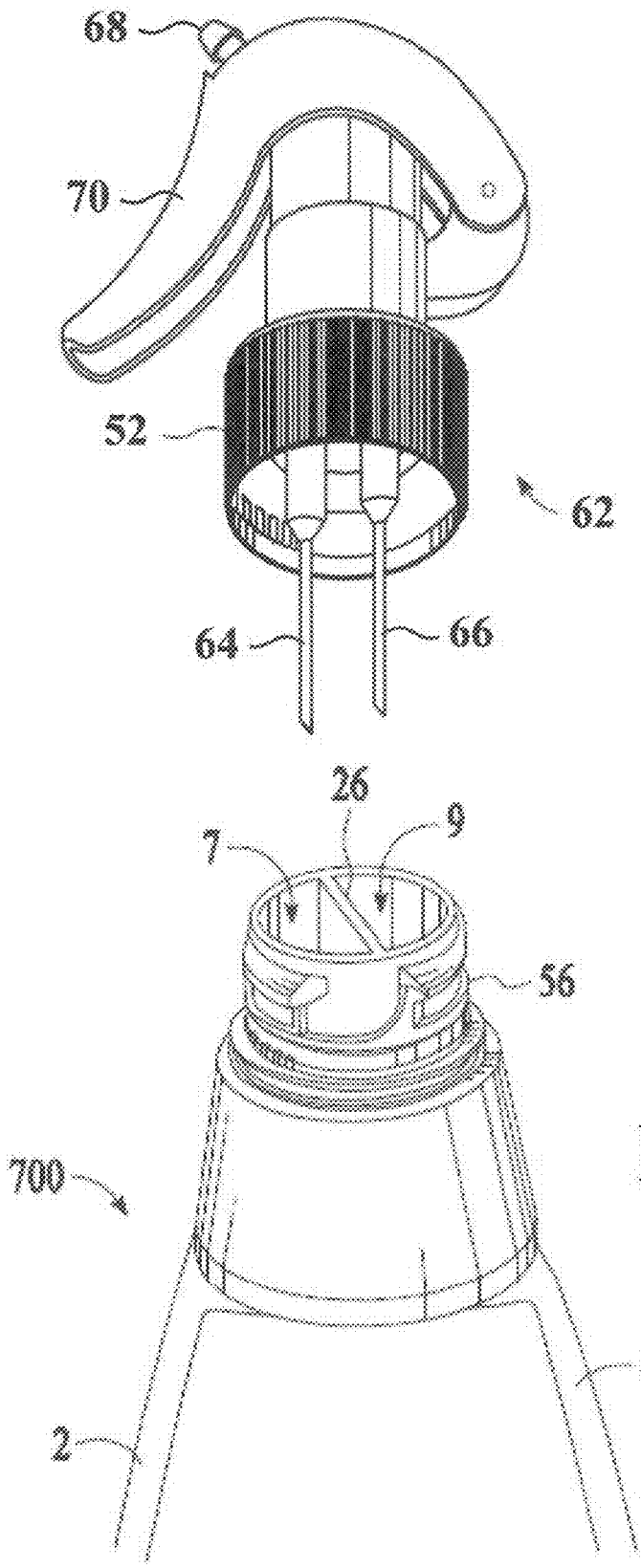
FIG. 7 shows a perspective view of an example package including a multi-chamber fluid dispensing container and a trigger spray, both in accordance with various embodiments of the present disclosure.

FIG. 7 illustrates an example package in accordance with various embodiments of the present invention. The package includes a container 700 and the trigger sprayer 62 described herein. As shown, the container 700 includes a first dip tube 2 and a second dip tube 4. The container 700 may include a first interior volume 7 and a second interior volume 9, with a divider wall 26 separating the interior volumes 7, 9 from each other.

The container 700 may include a fitment 56 configured to couple the container 700 to the trigger sprayer 62. As shown, for example, the container 700 may include a bayonet-type fitment 56 for coupling to a bayonet-type attachment connector 52 of the trigger sprayer 62.

Figure 8:
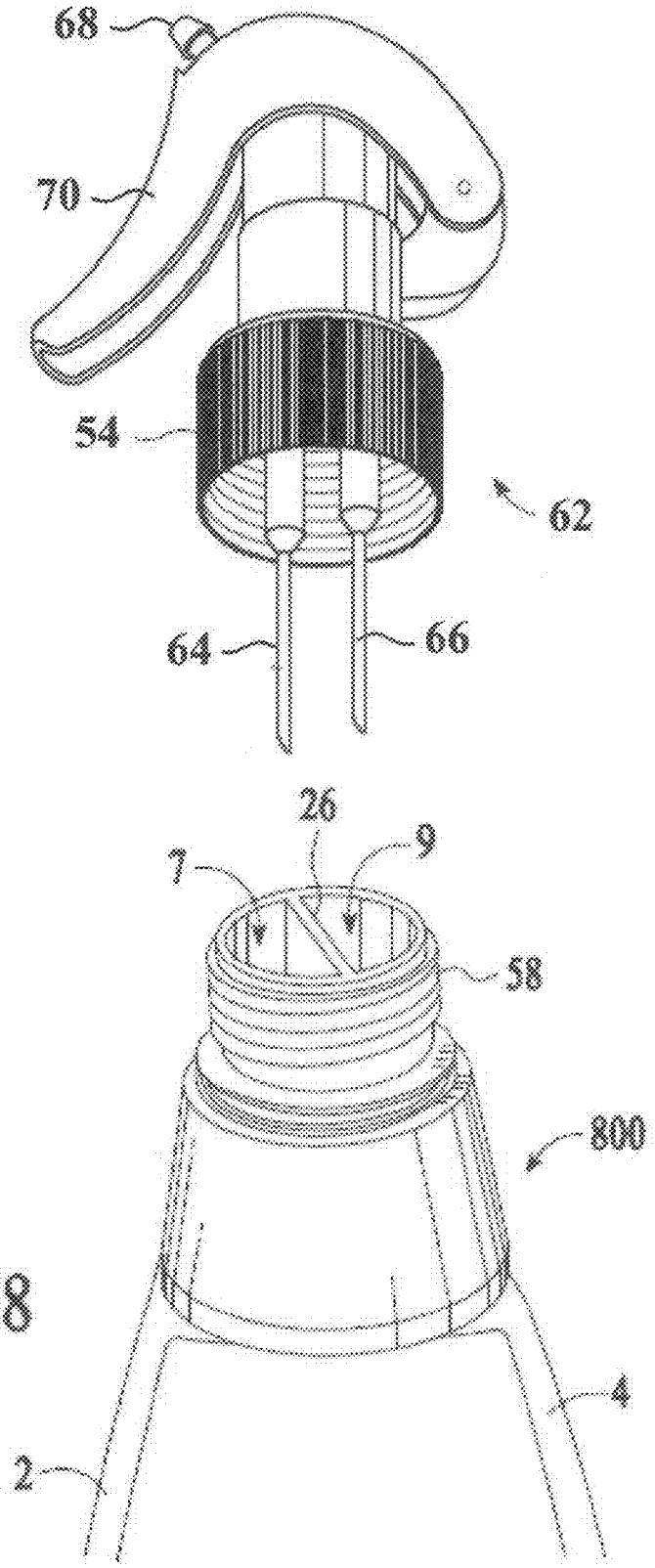
FIG. 8 shows a perspective view of an example package including a multi-chamber fluid dispensing container and a trigger sprayer, both in accordance with various embodiments of the present disclosure.

Alternatively, as shown in FIG. 8, a container 800 may include a threaded fitment 58 for coupling the container 800 to a trigger sprayer 62 having complementary threaded attachment connector 54.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the appended claims.

What is claimed is:

1. A multi-chamber fluid dispensing container comprising:

a body having a bottom, a first wall defining a first interior volume and a second wall defining a second interior volume;

a neck formed to the body and defining a first opening to the first interior volume and a second opening to the second interior volume;

a first dip tube exteriorly formed to the first wall, separated from the first wall by a first partition, fluidly connected to the first interior volume at the bottom of the body, and fluidly connected to the first interior volume below a top of the neck;

a second dip tube exteriorly formed to the second wall, separated from the second wall by a second partition, fluidly connected to the second interior volume at the bottom of the body, and fluidly connected to the second interior volume below the top of the neck wherein the first dip tube is fluidly connected to the first interior volume at a first landing below the top of the neck, and wherein the second dip tube is fluidly connected to the second interior volume at a second landing below the top of the neck; and wherein one or both of the first landing and the second landing are funnel-shaped.

2. The multi-chamber fluid dispensing container of claim 1, wherein the distance between the top of the neck and the first landing, and the distance between the top of the neck and the second landing is equal to or greater then a length of a fitment.

3. The multi-chamber fluid dispensing container of claim 1, wherein the first dip tube and second dip tubes are disposed on opposite sides of the body of the container.

4. The multi-chamber fluid dispensing container of claim 1, wherein the body further comprises a divider wall separating the first interior volume and the second interior volume.

5. The multi-chamber fluid dispensing container of claim 1, wherein the first interior volume has a fluid capacity that is the same as a fluid capacity of the second interior volume.

6. The multi-chamber fluid dispensing container of claim 1, wherein the first interior volume has a fluid capacity that is the different from a fluid capacity of the second interior volume.

7. The multi-chamber fluid dispensing container of claim 1, further comprising a fitment below the top of the neck.

8. The multi-chamber fluid dispensing container of claim 7, wherein the fitment is a bayonet-type fitment.

9. The multi-chamber fluid dispensing container of claim 7, wherein the fitment is a threaded fitment.

10. The multi-chamber fluid dispensing container of claim 7, wherein the fitment is a snap-fit fitment.

11. An improved multi-chamber fluid dispensing package of the type in which a trigger sprayer is operated to draw fluid from separate chambers of a container via first and second fluid lines and dispense the fluid as a combined stream via a nozzle, wherein improvement comprises:

multi-chamber fluid dispensing container including;

a first dip tube exteriorly formed to a first wall of a body of the container, separated from the first wall by a first partition, and fluidly connected to a first interior volume of the container;

a second dip tube exteriorly formed to a second wall of the body of the container, separated from the second wall by a second partition, and fluidly connected to a second interior volume of the container;

a neck portion; and wherein the trigger sprayer is configured to couple to the neck portion of the container with the first fluid supply line fluidly connected to the first dip tube, and the second fluid supply line connected to the second dip tube.

12. The improved multi-chamber fluid dispensing package of claim 11, wherein the first interior volume is different from the second interior volume.

13. The improved multi-chamber fluid dispensing package of claim 11, wherein the neck portion defines a first opening to the first interior volume and a second opening to the second interior volume, wherein the first dip tube is fluidly connected to the first interior volume at a bottom of the body, and fluidly connected to the first interior volume below a top of the neck portion, and wherein the second dip tube is fluidly connected to the second interior volume at the bottom of the body, and fluidly connected to the second interior volume below the top of the neck portion.

14. The improved multi-chamber fluid dispensing package of claim 11, wherein the trigger sprayer includes an attachment connector and wherein the neck portion of the multi-chamber fluid dispensing container includes a fitment configured to correspond to the attachment connector of the trigger sprayer, wherein the fitment is a threaded fitment, a bayonet-type fitment, or a snap-fit fitment.

15. A multi-chamber fluid dispensing container comprising:

a body having a bottom, a first wall defining a first interior volume and a second wall defining a second interior volume;

a neck formed to the body and defining a first opening to the first interior volume and a second opening to the second interior volume;

a fitment below a top of the neck;

a first dip tube exteriorly formed to the first wall, separated from the first wall by a first partition, fluidly connected to the first interior volume at the bottom of the body, and fluidly connected to the first interior volume below the top of the neck, wherein the first dip tube is fluidly connected to the first interior volume at a first landing below the top of the neck;

a second dip tube exteriorly formed to the second wall, separated from the second wall by a second partition, fluidly connected to the second interior volume at the bottom of the body, and fluidly connected to the second interior volume below the top of the neck, wherein the second dip tube is fluidly connected to the second interior volume at a second landing below the top of the neck; and a divider wall separating the first interior volume and the second interior volume;

wherein the distance between the top of the neck and the first landing, and the distance between the top of the neck and the second landing, is equal to or greater than a length of the fitment; and wherein one or both of the first landing and the second landing are funnel-shaped.

* * * * *